US012048412B2

(12) United States Patent
Mi et al.

(10) Patent No.: US 12,048,412 B2
(45) Date of Patent: Jul. 30, 2024

(54) INTELLIGENT CLEANING DEVICE

(71) Applicant: Beijing Roborock Technology Co., Ltd., Beijing (CN)

(72) Inventors: Chang Mi, Beijing (CN); Dahong Gong, Beijing (CN); Guang Yu, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 500 days.

(21) Appl. No.: 17/357,294

(22) Filed: Jun. 24, 2021

(65) Prior Publication Data

US 2021/0315431 A1 Oct. 14, 2021

Related U.S. Application Data

(63) Continuation of application No. PCT/CN2019/111766, filed on Oct. 17, 2019.

(30) Foreign Application Priority Data

Dec. 29, 2018 (CN) ..... 201811641913.6

(51) Int. Cl.
*A47L 9/28* (2006.01)
*A47L 9/00* (2006.01)
(Continued)

(52) U.S. Cl.
CPC ..... *A47L 9/2852* (2013.01); *A47L 9/009* (2013.01); *A47L 9/0477* (2013.01);
(Continued)

(58) Field of Classification Search
CPC ..... A47L 9/2852; A47L 9/009; A47L 9/0477; A47L 9/2884; A47L 11/24;
(Continued)

(56) References Cited

U.S. PATENT DOCUMENTS 5,440,216 A * 8/1995 Kim ..... G05D 1/0219 15/340.1
9,725,013 B2 * 8/2017 Romanov ..... B60L 50/66
(Continued)

FOREIGN PATENT DOCUMENTS

CN 205144460 U 4/2016
CN 105982611 A 10/2016
(Continued)

OTHER PUBLICATIONS

International Search Report issued in related International Patent Application No. PCT/CN2019/111766 dated Jan. 15, 2020.

*Primary Examiner* — David Luo
(74) *Attorney, Agent, or Firm* — Morgan, Lewis & Bockius LLP

(57) ABSTRACT

Embodiments of the present application provide an intelligent cleaning device, where the intelligent cleaning device includes a device body, a driving wheel assembly, a control circuit, and a transfer circuit; the driving wheel assembly is mounted to the device body from below, and is configured to make the intelligent cleaning device movable; the control circuit is configured to control operation of the intelligent cleaning device, and the control circuit is arranged in the device body; the driving wheel assembly is electrically connected to the control circuit through the transfer circuit, and the transfer circuit is arranged at the device body.

14 Claims, 4 Drawing Sheets

(51) Int. Cl.
*A47L 9/04* (2006.01)
*A47L 11/24* (2006.01)
*A47L 11/40* (2006.01)

(52) U.S. Cl.
CPC ..... *A47L 9/2884* (2013.01); *A47L 11/24* (2013.01); *A47L 11/4005* (2013.01); *A47L 11/4011* (2013.01); *A47L 11/4066* (2013.01); *A47L 2201/04* (2013.01)

(58) Field of Classification Search
CPC ..... A47L 11/4005; A47L 11/4011; A47L 11/4066; A47L 2201/04; A47L 2201/00; A47L 11/4072; A47L 11/40
USPC ..... 318/17, 3
See application file for complete search history.

(56) References Cited

U.S. PATENT DOCUMENTS

| | | | | |
|---|---|---|---|---|
| 9,950,586 | B2 * | 4/2018 | Park | A47L 11/4066 |
| 10,092,157 | B2 * | 10/2018 | Yang | A47L 11/4011 |
| 2010/0139029 | A1 | 6/2010 | Kim | |

FOREIGN PATENT DOCUMENTS

| | | | |
|---|---|---|---|
| CN | 108294696 | A | 7/2018 |
| CN | 207979620 | U | 10/2018 |
| KR | 10-1018720 | B1 | 3/2011 |
| TW | 201828873 | A | 8/2018 |

* cited by examiner

INTELLIGENT CLEANING DEVICE

CROSS-REFERENCE TO RELATED APPLICATIONS

The present application is a continuation application of International Application No. PCT/CN2019/111766, filed on Oct. 17, 2019, which claims priority to Chinese Patent Application No. CN201811641913.6 filed on Dec. 29, 2018, both of which are incorporated herein by reference in their entireties for all purposes.

TECHNICAL FIELD

The present application relates to the field of cleaning tool technologies, and more specifically, to an intelligent cleaning device.

BACKGROUND

With the rapid development of communications technologies, usage of intelligent products is more prevalent in daily life. Many self-moving intelligent cleaning devices such as intelligent sweeping devices have appeared. The intelligent cleaning devices can automatically perform cleaning operations, which bring convenience for users. However, as the functions of the intelligent cleaning device gradually become more powerful, the number of functional modules of the device increase, and the structure of the device becomes increasingly complex. When a component of the intelligent cleaning device has malfunctioned and needs to be repaired, both the time required for disassembling the component and the difficulty of disassembling it increase, which brings challenges to the maintenance staff.

SUMMARY

A series of concepts in simplified forms are introduced in the SUMMARY section. These concepts are further described in detail in the DESCRIPTION OF EMBODIMENTS section. The SUMMARY section of the present application does not imply an attempt to define the key features and essential technical features of the claimed technical solutions, nor does it imply an attempt to determine the protection scope of the claimed technical solutions.

According to an aspect of the present application, an intelligent cleaning device is provided, where the intelligent cleaning device includes a device body, driving wheel assemblies, a control circuit, and a transfer circuit; the driving wheel assemblies are mounted to the device body from below, and are configured to make the intelligent cleaning device movable; the control circuit is configured to control operation of the intelligent cleaning device, and the control circuit is arranged in the device body; the driving wheel assemblies are electrically connected to the control circuit through the transfer circuit, and the transfer circuit is arranged at the device body.

Optionally, the transfer circuit includes electrical connectors, and each driving wheel assembly is detachably connected to the control circuit through a respective electrical connector.

Optionally, the transfer circuit further includes a transfer circuit board, each electrical connector is at least partially supported on the transfer circuit board, and the transfer circuit board is arranged in the device body.

Optionally, the device body includes a chassis, the chassis has openings, and each electrical connector is arranged in a respective opening, and is configured to connect an electrical connection wire of the driving wheel assembly from a lower side of the chassis to the electrical connector.

Optionally, the lower side of the chassis is provided with an upwardly recessed receptacle, the receptacle extends from each driving wheel assembly to the respective opening, and the electrical connection wire is confined in the receptacle.

Optionally, the receptacle is further provided with a stopper portion, and the stopper portion has a through hole through which the electrical connection wire passes.

Optionally, the device body includes a chassis, and the transfer circuit board is covered only by the chassis from below.

Optionally, each driving wheel assembly includes a driving wheel and a motor that drives the driving wheel, the motor is electrically connected to the transfer circuit through the electrical connector, and the electrical connector and the motor are in one-to-one correspondence.

Optionally, the intelligent cleaning device further includes a cleaning assembly, the cleaning assembly is mounted to the device body from below, the cleaning assembly is provided with a plate, each driving wheel assembly includes a driving wheel assembly housing, and the plate is snap-fitted onto the driving wheel assembly housing from below to support the driving wheel assembly upward.

Optionally, the plate includes a plate body and a plate snap-fitting portion extending from the plate body, the plate body is mounted to the device body, the driving wheel assembly housing is provided with an upwardly recessed plate receiving groove, and the plate snap-fitting portion extends and is snap-fitted into the plate receiving groove.

Optionally, the control circuit is supported on a main circuit board, a driven wheel and a rechargeable battery are arranged below the main circuit board, and the driven wheel and the rechargeable battery are mounted to the device body.

BRIEF DESCRIPTION OF DRAWINGS

The following accompanying drawings of embodiments of the present application are used herein as a part of the present application for understanding of the present application.

The accompanying drawings show embodiments of the present application and descriptions of the embodiments, which are used to explain device and principles of the present application. In the drawings.

Figure 1:
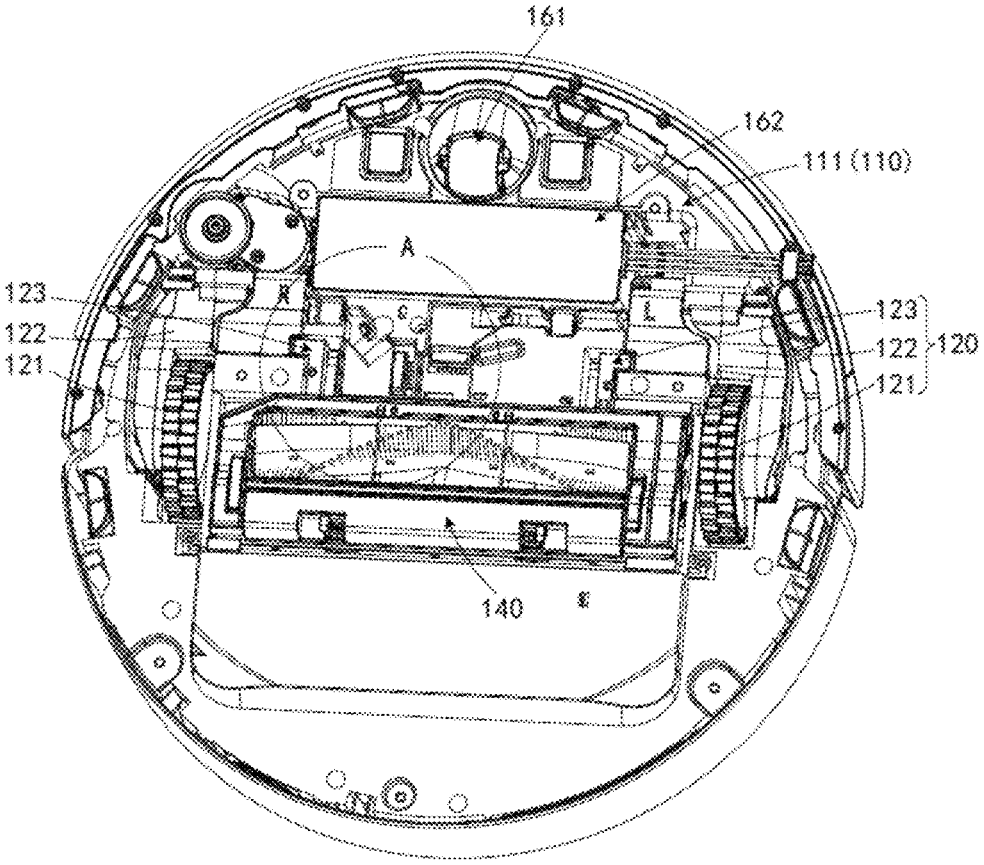
FIG. 1 is a schematic bottom view of an intelligent cleaning device according to an embodiment of the present application.

| Description of reference numerals: | |
|---|---|
| 110: | device body; |
| 111: | chassis |
| 112: | nut; |
| 113: | opening |
| 114: | receptacle; |
| 115: | stopper |

-continued

| Description of reference numerals: | |
|---|---|
| 116: | through hole; |
| 120: | driving wheel assembly |
| 121: | driving wheel; |
| 122: | driving wheel assembly housing |
| 123: | plate receiving groove; |
| 131: | main circuit board |
| 132: | transfer circuit board; |
| 133: | electrical connector |
| 133a: | socket portion; |
| 133b: | plug portion |
| 134: | electrical connection wire; |
| 140: | cleaning assembly |
| 141: | main brush; |
| 142: | cleaning assembly housing |
| 150: | plate; |
| 151: | plate body |
| 152: | plate snap-fitting portion; |
| 153: | screw hole |
| 161: | driven wheel; |
| 162: | rechargeable battery |

DESCRIPTION OF EMBODIMENTS

The following describes numerous specific details to provide a more thorough understanding of the present application. However, it is obvious to a person skilled in the art that the present application may be implemented without one or more of these details. In other examples, to avoid confusion with the present application, some technical features well-known in the art are not described.

To fully understand the present application, the following description provides a detailed structure to illustrate the present application. Clearly, the implementation of the present invention is not limited to the specific details well-known to a person skilled in the art. The following describes example embodiments of the present application in detail. However, in addition to these detailed descriptions, the present application may have other embodiments, and should not be construed as being limited to the embodiments provided herein.

It should be understood that the terms used herein are intended only to describe specific embodiments, and are not intended to limit the present invention. The singular forms of "a/an", "one", and "the/said" are also intended to include plural forms, unless the context clearly indicates another manner. The terms "include" and/or "comprise" used in this specification specify presence of the features, entireties, steps, operations, elements and/or components, but do not exclude presence or addition of one or more of other features, entireties, steps, operations, elements, components, and/or a combination thereof. The terms "upper", "lower", "front", "rear", "left", "right" and similar expressions used in the present application are merely intended for illustrative purposes, and are not intended to impose a limitation.

The ordinal numbers such as "first" and "second" cited in the present application are merely identifiers and do not have any other meaning, such as a particular order. Moreover, for example, the term "first part" does not imply the existence of a "second part" and the term "second part" does not imply the existence of a "first part".

The following describes in more detail specific embodiments of the present application with reference to the accompanying drawings. These accompanying drawings illustrate embodiments of the present application and are not intended to limit the present application.

Generally, an intelligent cleaning device mainly includes a device body 110 (FIG. 1). The device body 110 may be an approximate circular shape (both the front and the back are circular) or may be other shapes. It can be understood that, the intelligent cleaning device shown in the embodiments of the present application may be a sweeping robot, a mopping robot, a sweeping and mopping robot, or the like.

The intelligent cleaning device includes a cleaning system, a perception system, a control system, a driving system, an energy system, a man-machine interaction system, etc. Various systems cooperate with each other to make the intelligent cleaning device autonomously move and implement a cleaning function. Functional elements and the like that constitute the above-mentioned systems in the intelligent cleaning device are integrated into the device body 110. The device body 110 may include an upper cover, a chassis 111 (FIG. 1), and a middle frame arranged between the upper cover and the chassis. The middle frame may serve as a basic frame for arranging the various functional elements. The upper cover and the chassis cover a surface of the device body to protect internal parts and improve appearance of the intelligent cleaning device.

The perception system is used by the intelligent cleaning device to perceive an external environment such as topography. The perception system includes sensing apparatuses such as a position determining apparatus, a bumper, a cliff sensor, an ultrasonic sensor, an infrared sensor, a magnetometer, an accelerometer, a gyroscope, and an odometer. These sensing apparatuses provide various position information and motion state information of the intelligent cleaning device for the control system. The position determining apparatus includes but is not limited to an infrared emitting and receiving apparatus, a camera, and a laser ranging apparatus (laser distance sensor, LDS). The bumper is configured to relieve a collision between the intelligent cleaning devices and an object during movement. A layer of flexible material is provided on a surface of the bumper, the bumper is mounted to the device body, and the predetermined distance between the bumper and the device body can ensure sufficient time for the device body to decelerate in case of a collision.

Figure 4:
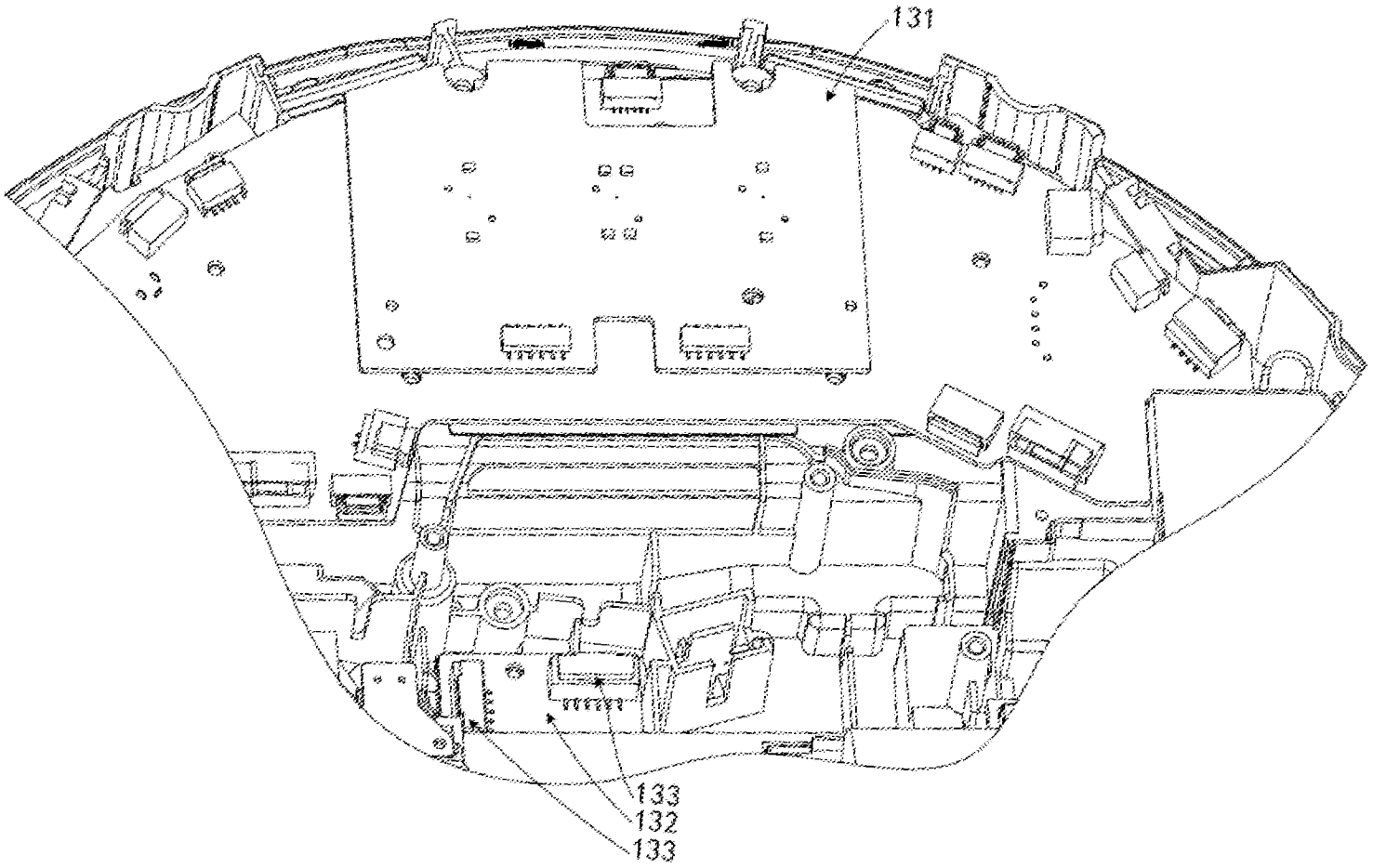
FIG. 4 is a schematic diagram of an internal structure of the intelligent cleaning device shown in FIG. 1, in which a part below a main circuit board is removed.

The control system is provided on a main circuit board 131 (refer to FIG. 4) in the device body 110. It can be understood that, the main circuit board 131 are provided with various control circuits for controlling operations of the intelligent cleaning device. The control system may include a non-transitory memory, a computing processor, etc. The computing processor may be a central processing unit, an application processor, etc. The computing processor generates, based on obstacle information provided by the laser ranging apparatus and a positioning algorithm, an instant map of an environment in which the intelligent cleaning device is located. With reference to distance information and velocity information provided by the bumper and the sensing apparatuses, the control system may determine a current working status of the intelligent cleaning device, such as crossing a threshold, crossing an edge of a carpet, reaching a cliff, getting stuck, having a full dust box, or being picked up. In addition, the control system provides a specific next action based on different situations, to cause the performance of the intelligent cleaning device to meet certain requirements and improve user experience.

The man-machine interaction system includes buttons on a panel of the robot, which are employed for a user to select functions. The man-machine interaction system may further include a display screen, an indicator, and/or a speaker, which provides the current status of the machine or function options for the user. The man-machine interaction system may further include a mobile phone application. For a route-navigated intelligent cleaning device, the mobile phone application can show a map of the environment in which the device is located, as well as the location of the intelligent device, to the user, thereby providing the user with abundant and user-friendly function options.

The energy system is configured to supply power to the functional elements of various systems, and mainly includes a rechargeable battery 162 (FIG. 1) and a power supply circuit. The rechargeable battery may be an NiMH battery or a lithium battery. When power of the rechargeable battery is less than a predetermined threshold, the rechargeable battery may be charged by contacting a charging device and a charging electrode disposed on a side or bottom of the device body of the device body.

The cleaning system is an important system of the intelligent cleaning device, and is configured to implement a cleaning function. The cleaning system may include a dry cleaning portion and a wet cleaning portion. The dry cleaning portion mainly removes loose particulates from a to-be-cleaned surface by using a cleaning brush and the like. The wet cleaning portion mainly mops the to-be-cleaned surface (such as a floor surface) by using a cleaning cloth that saturated with cleaning liquid.

The dry cleaning portion may mainly include a cleaning assembly 140 (FIG. 2), a waste container, and a vacuum. A main brush 141 in the cleaning assembly 140 can agitate debris. The vacuum is connected to the waste container through an air duct and configured to generate suction force. Specifically, as the intelligent cleaning device moves, the main brush comes in contact with the floor surface, the debris on the floor surface is agitated and taken to a suction door between the main brush and the waste container, and then sucked into the waste container by the suction force generated by the vacuum.

The wet cleaning portion may mainly include a liquid reservoir and a cleaning cloth. The liquid reservoir of the wet cleaning portion may be configured to contain cleaning liquid, and the cleaning cloth is detachably disposed on the liquid reservoir. After the dry cleaning portion completes cleaning, the liquid inside the liquid reservoir of the wet cleaning portion flows to the cleaning cloth, and the cleaning cloth mops the floor surface cleaned by the main brush and the like.

The dry cleaning portion may further include a side brush. The side brush is disposed on the device body with a rotation shaft. Specifically, the side brush may be mounted at the edge of the bottom of the device body with the rotating shaft. The side brush may rotate about the rotation shaft, so as to move the debris (for example, rubbish such as particulates and hair) into a cleaning region of the main brush.

Autonomous movement of the intelligent cleaning system is implemented by the driving system. The driving system mainly includes a driving wheel 121 (FIG. 1), a motor (not shown) that drives the driving wheel 121, and a control circuit that controls operation of the motor. The control circuit is usually disposed on the main circuit board 131. The intelligent cleaning device can move on the floor surface under the action of the driving system. To enable the intelligent cleaning device to move more stably on the floor surface or to have a strong motion ability, the intelligent cleaning device may include one or more driven wheels 161 (FIG. 1), and the driven wheel 161 include but is not limited to a universal wheel.

The following describes in detail a structure and/or construction of the driving system, and a structure and/or construction of an assembly/part related to the driving wheel system with reference to accompanying drawings.

Figure 3:
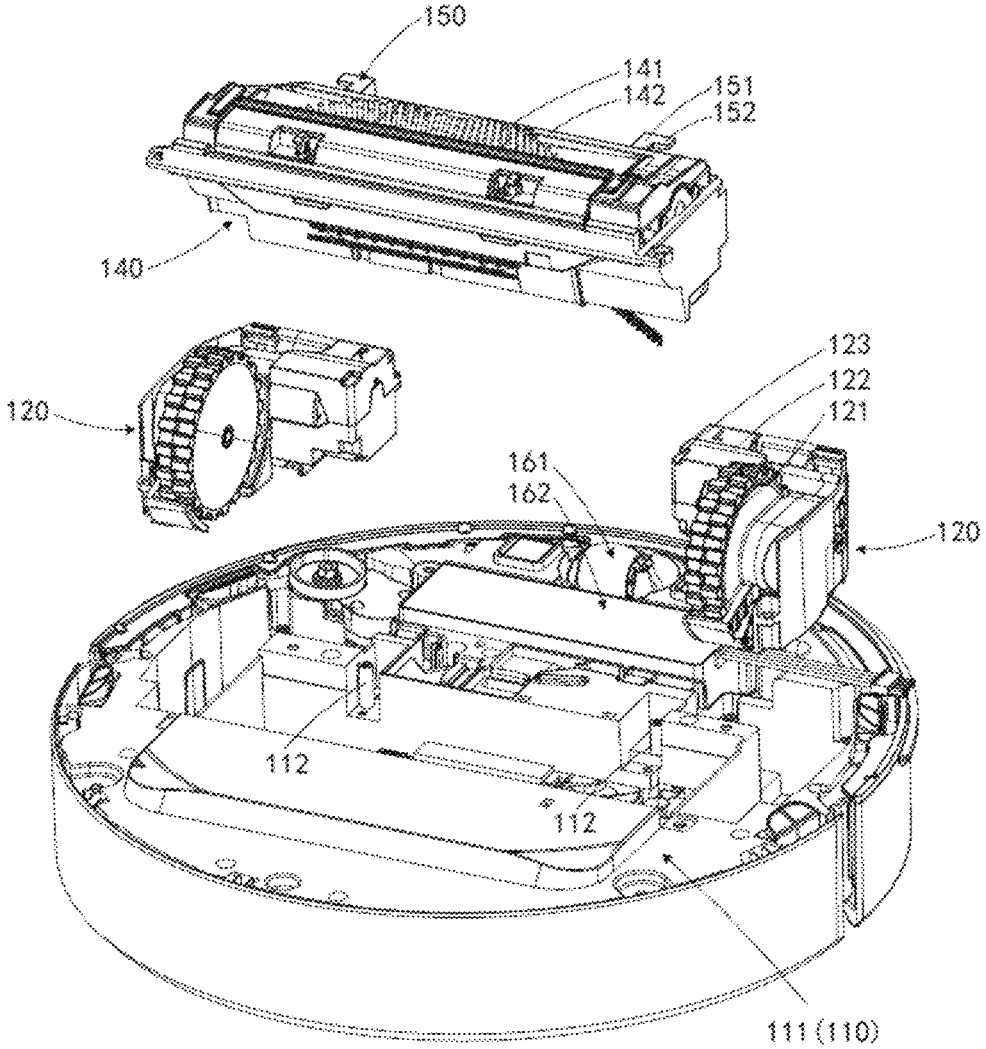
FIG. 3 is a schematic exploded diagram of the intelligent cleaning device shown in FIG. 1.

As shown in FIG. 1 and FIG. 3, a driving wheel assembly 120 may include a driving wheel 121 and a motor. The driving wheel assembly 120 is mounted on the lower portion of the device body 110, specifically, the driving wheel assembly 120 may be mounted on the chassis of the device body 110. To facilitate the mounting of the driving wheel 121 and the motor, the driving wheel assembly 120 may further include a driving wheel assembly housing 122. The driving wheel assembly housing 122 is mounted on the device body 110, and the driving wheel 121 and the motor are mounted in the driving wheel assembly housing 122. The driving wheel 121 is rotatable relative to the driving wheel assembly housing 122, and protrudes from the lower surface of the driving wheel assembly housing 122, so that the intelligent cleaning device can move by means of the driving wheel 121.

In this embodiment, the intelligent cleaning device further includes a transfer circuit for connecting the driving wheel assembly 120, and the transfer circuit is disposed on the device body 110. The transfer circuit is electrically connected to the control circuit for controlling operation of the driving wheel assembly, specifically, the motor of the driving wheel assembly. In other words, the driving wheel assembly 120 is electrically connected to the control circuit through the transfer circuit.

In the illustrated embodiment, the transfer circuit includes an electrical connector 133, and the driving wheel assembly 120 is detachably connected to the control circuit through the electrical connector 133. The transfer circuit further includes a transfer circuit board 132, the electrical connector 133 is at least partially disposed on the transfer circuit board 132, and the transfer circuit board 132 is disposed in the device body 110. Specifically, the main circuit board 131 and the transfer circuit board 132 are disposed separately. The electrical connector 133 is disposed on the transfer circuit board 132, and the motor is electrically connected to the control circuit through the electrical connector 133 and the transfer circuit board 132. In this embodiment, the control circuit may supply power to the motor through the transfer circuit, and the motor may respond to the control circuit by means of the connection of the transfer circuit, so as to control the operation of the motor. In other words, the circuits that make the motor operate include the control circuit and the transfer circuit. The transfer circuit may include electrical connection wires among the motor, the control circuit, and the transfer circuit, as well as the electrical connector and the circuit that is disposed on the transfer circuit board.

Figure 2:
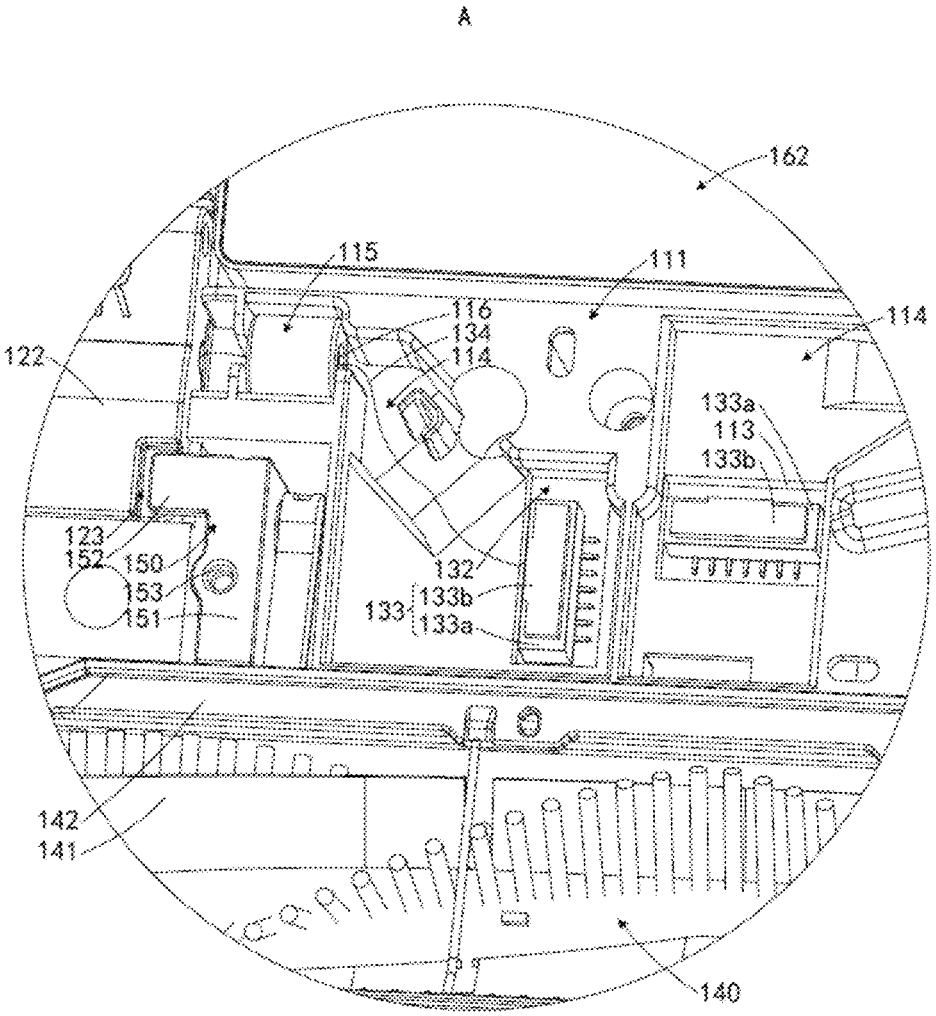
FIG. 2 is a schematic diagram of partially-enlarged part A shown in FIG. 1.

The electrical connector 133 may include a socket portion 133*a* disposed on the transfer circuit board 132 and a plug portion 133*b* connected to the electrical connection wire 134. FIG. 2 schematically shows the electrical connection wire 134 on the left side of the device with a dotted line. One end of the electrical connection wire 134 is connected to the plug portion 133*b*, and the other opposite end is connected to the motor. The plug portion 133*b* is inserted into the socket portion 133*a*. In this embodiment, the motor can be connected to the transfer circuit board 132 by means of the electrical connection wire 134 and the electrical connector 133. The connection between the motor and the transfer circuit board 132 may be broken by pulling out the plug portion 133*b* from the socket portion 133*a*.

Further, the cleaning assembly 140 is mounted to the lower portion of the device body 110, specifically, the cleaning assembly 140 may be mounted to the chassis 111.

The cleaning assembly 140 may include the main brush 141 and the cleaning assembly housing 142, and the cleaning assembly housing 142 is mounted to the device body 110. Optionally, the main brush 141 may be a rolling brush. The cleaning assembly housing 142 is provided with a recessed groove, and the main brush 141 is disposed in the groove. The main brush 141 is rotatable relative to the cleaning assembly housing 142, and the main brush 141 extends from the cleaning assembly housing 142, so that the main brush 141 is able to agitate debris on the floor.

In the illustrated embodiment, the cleaning assembly 140 may be disposed on the middle of the device body 110, and two driving wheel assemblies 120 may be respectively disposed on both sides of the cleaning assembly 140 along the length direction of the cleaning assembly 140. The transfer circuit board 132 may be disposed between the two driving wheel assemblies 120. Motors in the driving wheel assemblies 120 may be in one-to-one correspondence to the foregoing electrical connectors 133. Optionally, the two driving wheel assemblies 120 may be disposed substantially symmetrically. In other embodiments, the number of driving wheel assemblies 120 can be set as required.

The cleaning assembly 140 may be further provided with a plate 150. The plate 150 is snap-fitted onto the bottom of the driving wheel assembly housing 122 and to support the driving wheel assembly housing 122. According to the embodiment, stability between the driving wheel assembly 120 and the cleaning assembly 140 can be improved. Specifically, the plate 150 includes a plate body 151 and a plate snap-fitting portion 152 extending from the plate body 151. The plate body 151 is disposed to the cleaning assembly housing 142 and extends outward from the cleaning assembly housing 142 in a width direction of the cleaning assembly 140. The "outward" here refers to a direction away from the cleaning assembly 140. The plate 150 may be disposed on the inner side of the driving wheel assembly 120. The driving wheel assembly housing 122 may be provided with an upwardly recessed plate receiving groove 123, and the plate snap-fitting portion 152 is snap-fitted into the plate receiving groove 123. In the illustrated embodiment, the plate receiving groove 123 is disposed on the inner side of the driving wheel assembly 120 and is disposed at a corner of the driving wheel assembly. It can be understood that, the plate receiving groove 123 may be regarded as a recess located at the corner.

The plates 150 may be disposed to respective ends of the cleaning assembly 140 along its length direction. The plates 150 may be in one-to-one correspondence to the driving wheel assemblies 120. Optionally, the plate body 151 can be fixed to the device body 110. For example, the plate body 151 is provided with a screw hole 153 (FIG. 2), and the device body 110 is provided with a downwardly extending nut 112 (FIG. 3). The screw can be mounted to the nut 112 through the screw hole 153. In this way, the plate body 151 is detachably mounted on the device body 110. If the driving wheel assembly 120 needs to be detached from the device body 110, the cleaning assembly 140 and the plate 150 are first detached, and then the driving wheel assembly 120 is detached from the device body 110. It can be understood that, if the driving wheel assembly 120 needs to be mounted to the device body 110, the driving wheel assembly 120 is mounted first, and then the cleaning assembly 140 and the plate 150 are mounted.

As shown in FIG. 1 and FIG. 2, the chassis 111 is located below the transfer circuit board 132. In other words, the chassis 111 may support the bottom of the transfer circuit board 132. In the illustrated embodiment, only the chassis 111 is disposed below the transfer circuit board 132. The chassis 111 may be provided with an opening 113, and the electrical connector 133 is disposed in the opening 113. The opening 113 in this embodiment acts as a through hole to expose the electrical connector 133. The socket portion 133*a* of the electrical connector 133 is disposed in the opening 113, the electrical connection wire 134 extends to the opening 113, and the plug portion 133*b* connected to the electrical connection wire 134 is connected to the socket portion 133*a* from a lower part of the opening 113.

Optionally, the bottom of the chassis 111 is provided with a recessed receptacle 114, and the receptacle 114 may extend from the driving wheel assembly 120 to the opening 113. The electrical connection wire 134 is routed from the driving wheel assembly 120 to the opening 113 along the receptacle 114, and the electrical connection wire 134 may be confined in the receptacle 114 for neatening the wire. The receptacle 114 may be further provided with a stopper portion 115. The stopper portion 115 has a through hole 116 extending along the extending direction of the receptacle 114, and the electrical connection wire 134 can pass through the through hole 116, so that the electrical connection wire 134 can be further confined.

In the illustrated embodiment, a driven wheel 161 and the foregoing rechargeable battery 162 may be disposed below the main circuit board 131. Specifically, the driven wheel 161 and the rechargeable battery 162 are mounted on the chassis 111 and located on a side of the transfer circuit board 132. If the driving wheel assembly 120 needs to be detached from the device body 110, there is no need to detach the chassis and the components disposed on the chassis, i.e., the driven wheel, and the rechargeable battery 162. And the driving wheel assembly 120 can be detached from the device body by pulling the plug portion 133*b* out from the socket portion 133*a*.

In an embodiment not shown, the transfer circuit may not include the foregoing transfer circuit board, but includes an electrical connector having a plug portion and a socket portion. The driving wheel assembly is electrically connected to the control circuit through the electrical connector. For example, the electrical connector is disposed on the device body (specifically, the chassis). The electrical connection wire extending from the motor of the driving wheel assembly is provided with a plug portion, and the electrical connection wire extending from the control circuit is provided with a socket portion. The motor and the control circuit can be connected by inserting the plug portion into the socket portion. The driving wheel assembly can be detached from the device body by pulling the plug portion from the socket portion. In this embodiment, it can be understood that the electrical connector may be located below the chassis, and the electrical connection wire connected to the electrical connector may extend under the chassis, or may be fixed under the chassis.

In summary, in the intelligent cleaning device provided in the embodiments of the present application, the driving wheel assembly may be electrically connected to the control circuit by means of the transfer circuit. The driving wheel assembly can be detached by detaching the electrical connection wire connected between the driving wheel assembly and the transfer circuit. The detachment process is simple and convenient, facilitating maintenance and replacement of the driving wheel assembly. Furthermore, according to the embodiment of the present application, the driving wheel assembly and the control circuit connect to the transfer circuit with electrical connection wires, which may relieve the effect on the connections between the driving wheel assembly and the control circuits caused by the vibration produced during operation of the intelligent cleaning device. Consequently, the failure rate of the intelligent cleaning device can be reduced.

Unless otherwise defined, the technical and scientific terms used in the present application have the same meanings as those commonly understood by a person skilled in the art of the present invention. The terms used in the present application are merely for the purpose of describing specific implementation, and are not intended to limit the present application. Terms such as "portion" and "part" that appear in the present application may represent either a single part or a combination of multiple parts. Terms such as "mount" and "arrange" that appear in the present application may indicate that one part is attached directly to another part, or may indicate that one part is attached to another part by using an intermediate part. In the present application, a feature described in one embodiment may be applied to another embodiment individually or in combination with other features, unless the feature is not applicable or otherwise stated in the another embodiment.

The present application has been described by using the foregoing embodiments, but it should be understood that the foregoing embodiments are used only for the purposes of illustration and description, and are not intended to limit the present application to the scope of the described embodiments. In addition, a person skilled in the art may understand that the present application is not limited to the foregoing embodiments, and further variations and modifications may be made according to the teachings of the present application. These variations and modifications fall within the protection scope of the present application. The protection scope of the present application shall be subject to the appended claims and their equivalent range.

What is claimed is:

1. An intelligent cleaning device, comprising:

a device body;

driving wheel assemblies mounted to the device body and configured to propel the intelligent cleaning device;

a control circuit configured to control operation of the intelligent cleaning device and disposed in the device body; and a transfer circuit disposed in the device body, wherein the driving wheel assemblies are electrically connected to the control circuit through the transfer circuit, wherein the transfer circuit comprises electrical connectors, and each of the driving wheel assemblies is detachably connected to the control circuit through a respective one of the electrical connectors, and wherein the device body comprises a chassis, the chassis is provided with openings, and each of the electrical connectors is disposed in a respective one of the openings.

2. The intelligent cleaning device according to claim 1, wherein the transfer circuit further comprises a transfer circuit board, each of the electrical connectors is at least partially disposed on the transfer circuit board, and the transfer circuit board is disposed in the device body.

3. The intelligent cleaning device according to claim 2, wherein the device body comprises a chassis, and the transfer circuit board exposes when the chassis is removed.

4. The intelligent cleaning device according to claim 2, wherein an electrical connection wire, connecting each of the driving wheel assemblies and the respective one of the electrical connectors, is disposed below the chassis.

5. The intelligent cleaning device according to claim 4, wherein a bottom of the chassis is provided with a receptacle, the receptacle extends from each of the driving wheel assemblies to the respective one of the openings, and the electrical connection wire is confined in the receptacle.

6. The intelligent cleaning device according to claim 5, wherein the receptacle is further provided with a stopper portion, and the stopper portion has a through hole through which the electrical connection wire passes.

7. The intelligent cleaning device according to claim 1, wherein an electrical connection wire, connecting each of the driving wheel assemblies and the respective one of the electrical connectors, is disposed below the chassis.

8. The intelligent cleaning device according to claim 7, wherein a bottom of the chassis is provided with a receptacle, the receptacle extends from each of the driving wheel assemblies to the respective one of the openings, and the electrical connection wire is confined in the receptacle.

9. The intelligent cleaning device according to claim 8, wherein the receptacle is further provided with a stopper portion, and the stopper portion has a through hole through which the electrical connection wire passes.

10. The intelligent cleaning device according to claim 1, wherein each of the driving wheel assemblies comprises a driving wheel and a motor that drives the driving wheel, and the motor is electrically connected to the transfer circuit through the electrical connector.

11. The intelligent cleaning device according to claim 10, wherein the motor of each of the driving wheel assemblies corresponds to a respective one of the electrical connectors.

12. The intelligent cleaning device according to claim 1, further comprising a cleaning assembly, wherein the cleaning assembly is mounted to a bottom of the device body, the cleaning assembly is provided with a plate, each of the driving wheel assemblies comprises a driving wheel assembly housing, and the plate is snap-fitted onto a bottom of the driving wheel assembly housing to support the driving wheel assembly.

13. The intelligent cleaning device according to claim 12, wherein the plate comprises a plate body and a plate snap-fitting portion extending from the plate body, the plate body is mounted to the device body, and the driving wheel assembly housing is provided with a plate receiving groove for receiving the plate snap-fitting portion.

14. The intelligent cleaning device according to claim 1, wherein the control circuit is supported on a main circuit board, a driven wheel and a rechargeable battery are disposed below the main circuit board, and the driven wheel and the rechargeable battery are mounted to the device body.

* * * * *